US009924749B2

(12) United States Patent
Walker

(10) Patent No.: US 9,924,749 B2
(45) Date of Patent: Mar. 27, 2018

(54) SYSTEM AND METHOD FOR MODIFICATION OF SHIRT INTO A DRESS

(71) Applicant: Mariangela C Walker, Pittsboro, NC (US)

(72) Inventor: Mariangela C Walker, Pittsboro, NC (US)

( * ) Notice: Subject to any disclaimer, the term of this patent is extended or adjusted under 35 U.S.C. 154(b) by 281 days.

(21) Appl. No.: 14/329,649

(22) Filed: Jul. 11, 2014

(65) Prior Publication Data

US 2016/0007660 A1 Jan. 14, 2016

(51) Int. Cl.

| | |
|---|---|
| ***A41D 1/22*** | (2018.01) |
| ***A41D 15/00*** | (2006.01) |
| *A41B 1/06* | (2006.01) |
| *A41D 1/14* | (2006.01) |

(52) U.S. Cl.

CPC ..... *A41D 1/22* (2013.01); *A41D 15/002* (2013.01); *A41B 1/06* (2013.01); *A41D 1/14* (2013.01)

(58) Field of Classification Search

CPC ..... A41D 1/22; A41D 1/14; A41D 15/002; A41B 1/06; G06Q 30/0601

See application file for complete search history.

(56) References Cited

U.S. PATENT DOCUMENTS 4,149,246 A * 4/1979 Goldman ..... A41H 3/007 700/132
4,598,376 A * 7/1986 Burton ..... A41H 1/02 33/17 A
4,873,643 A * 10/1989 Powell ..... B41C 1/145 345/632
5,768,135 A * 6/1998 Park ..... A41H 1/10 700/130
6,564,118 B1 * 5/2003 Swab ..... G06Q 30/02 700/130
2004/0090468 A1 * 5/2004 Cruikshank ..... H04N 1/3871 715/838
2006/0015207 A1 * 1/2006 Weiser ..... G06Q 10/06 700/132
2008/0243643 A1 * 10/2008 Knight ..... G06Q 30/02 705/26.5
2008/0249652 A1 * 10/2008 Burr ..... A41H 3/007 700/132
2009/0222127 A1 * 9/2009 Lind ..... A41H 3/007 700/132
2014/0277683 A1 * 9/2014 Gupta ..... G06F 17/50 700/132

OTHER PUBLICATIONS

May 2013—http://dressagirlaroundtheworld-va.blogspot.com/2013/05/the-best-t-shirt-dress-tutorial.html.*

* cited by examiner

*Primary Examiner* — Matthew E Zimmerman
(74) *Attorney, Agent, or Firm* — John L Sotomayor

(57) ABSTRACT

The present invention is a method and system to permit joining a shirt together with a skirt portion or fabric in a retail location to form a dress. The shirt may be brought to the retail location by a customer, or may be purchased within the retail location. The retail location employees assist in the selection of a skirt portion or fabric from which a skirt portion may be constructed, perform physical measurement or otherwise gather measurement data of the customer, and create the dress to the specifications of the customer. The customer is presented with a dress that was created with customer input.

16 Claims, 4 Drawing Sheets

SHIRT TO DRESS RETAIL LOCATION 100

400

SYSTEM AND METHOD FOR MODIFICATION OF SHIRT INTO A DRESS

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Typically an item of clothing serves a single purpose. In the fashion industry clothing and accessories are created largely with a single, direct use in mind. Modifying existing clothing articles to suit another purpose is generally done in a home and in an ad hoc manner. Retail locations that offer the re-purpose or modification of existing articles of clothing are largely restricted to seamstress or tailor shops and tend to be costly. The modification of existing articles of clothing is generally not done by most individuals because of the lack of sewing knowledge and skill or due to issues of cost, even for articles of clothing that are casual and are not expected to be used in other than casual situations.

BRIEF DESCRIPTION

A system and method for the creation of a dress through the modification of an existing shirt in a retail location is recited herein. A designer in the retail location receives a shirt from a shopper within a retail location. The designer measures the shopper to determine size and fit parameters and assists the shopper in selecting a skirt portion, or fabric for the manufacture of a skirt portion, from supplies of such skirt portions or fabric in the retail location. The designer takes both the shirt and the skirt portion to an assembly section of the retail location and joins the shirt to the skirt portion using one of the joining methods as described herein that is both secure and flexible so as to form a dress where the shirt forms the top portion of the finished dress and the skirt forms the bottom part of the finished dress. The designer or other employee of the retail location conveys the dress to the shopper through the retail location and accepts payment for the dress at a point of sale section in the retail location.

In an exemplary embodiment, the system and method for the creation of a dress in a retail location is disclosed. The staff at the retail location receives a shirt from a shopper within a retail location. The shopper or staff person selects a skirt portion from supplies of such skirt portions in the retail location and joins the shirt to the skirt portion so as to form a dress. The shopper is presented with the completed dress in the retail location, and payment is accepted through a payment method accepted by the retail location for the dress.

In an additional embodiment, the shirt received from a shopper may either be a shirt the shopper brings to the retail location from outside the retail location, or a shirt the shopper purchases from the retail location. The shopper is measured physically through the use of a measuring tape, size charts, computer scanning, or visual scanning for a skirt portion to be joined to the shirt. The skirt portion is selected from the stock of skirt portions or fabric available for sale, from which a skirt is constructed within the retail location, and the joining of the shirt to the selected skirt portion is performed in an assembly section of the retail location. The joining may further comprise placing the lower edge of the shirt and the upper edge of the selected skirt portion adjacent to one another to permit a sewing stitch to be applied to the circumference of the shirt and skirt portions so as to form a single garment that is the dress. The dress may be either joined or modified with additional fabric, or elements such as lace, fringe, beading, or other accessories as requested by a shopper. The shopper does not receive possession of the dress until the payment offered is accepted by the retail location.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
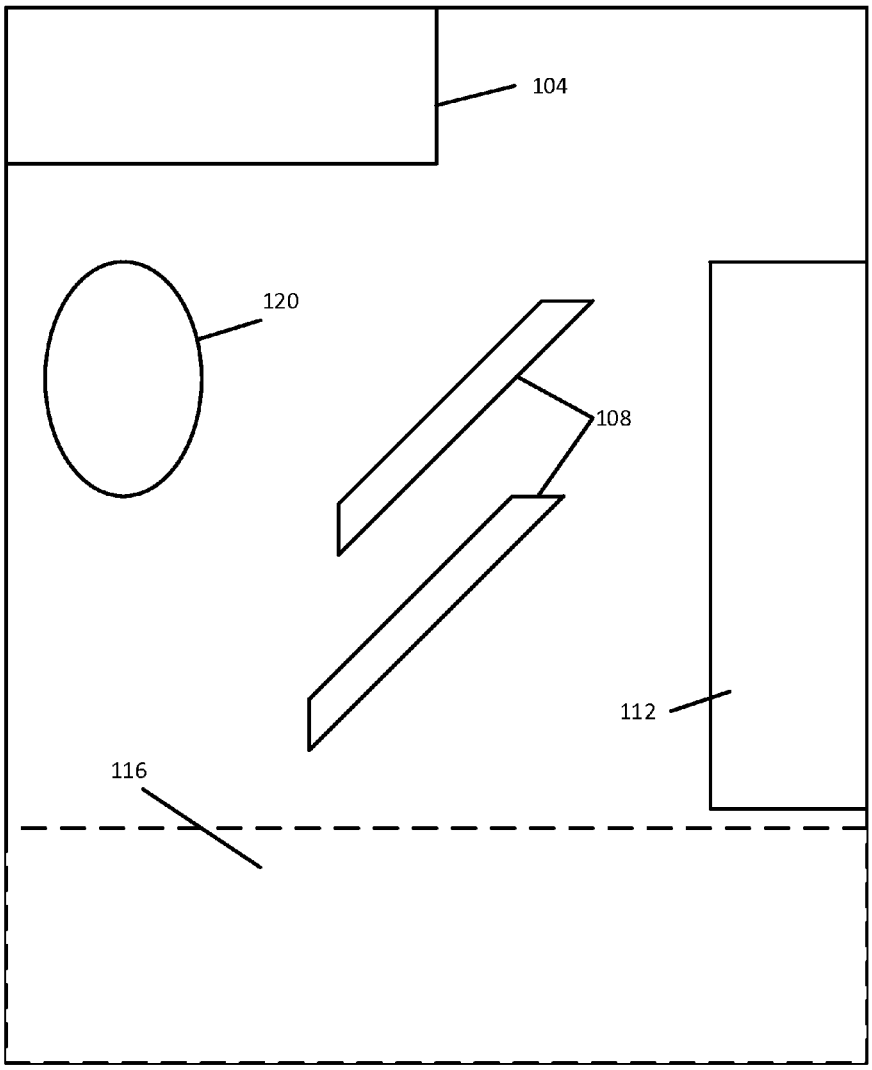
FIG. 1 is a view of a tee-skirt dress consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

A "shirt" for the purposes of this disclosure is defined as a shirt that covers the torso and shoulders of the wearer and is generally at or slightly below the waist of the wearer in length. The shirt may or may not have sleeves that extend past the points of the shoulder of a wearer. A shirt may have a straight, scooped, collared, V-shaped, or other top opening through which the wearer's head is inserted. A shirt is generally manufactured of cotton, polyester, or predominately blends of cotton fabric, but this should not be considered limiting, as a shirt may also be manufactured from any fabric of which a shirt may be manufactured. Shirts may also be those shirts currently described as tops, jerseys, casual wear, tee shirts, sports jerseys, lacrosse shirts, themed shirts, soccer jerseys, or any other shirt that is intended to be worn on the top half of the human body, except button-down dress shirts, which button all the way down the front of the shirt. The shirt is generally intended for casual wear, such as on a vacation day or a day at the beach, however, this should not be considered limiting as a shirt may also be worn to less casual events or formal events.

A retail location may be any of dress specialty stores, a location in a shopping mall, on-line storefront, fabric shop, shopping mall kiosk, department store kiosk, fashion truck, airport or airplane kiosk, pop-up locations (music festivals, sporting events, fund raising events, public or private parties), retail catalog, internet retail websites, yachts, hotel or resort locations, train or tour boat locations, water or theme park locations, and/or luxury resorts.

A retail location may be a physical location or a virtual location. A physical location is a physical storefront as previously disclosed. A virtual retail location is one that has a store front or presence on the Internet that may be accessed through a webpage on the Internet, in any virtual shopping destination, is part of a stand-alone virtual shopping experience, is part of a networked shopping experience; implemented in one or more virtual computer locations, is part of any online gaming virtual world, is part of a virtual catalog, or is implemented in any computer network cloud or simulation of a retail space existing now or created in the future.

There is a need for a retail location that provides an average consumer with the ability to modify an existing shirt into a longer length finished dress, where the finished dress comprises a top portion that is a shirt and the bottom portion is a skirt portion. In a non-limiting embodiment, one object of the present invention is to provide a location for individuals to bring a favored shirt to a retail location, either physical or virtual such as an internet store front, present the individual with a range of options for material for a skirt portion to be added to the shirt, of whatever variety, obtain the individual's measurements, modify the shirt using the individual's measurements into a longer length article of clothing that is suitable to be worn as a dress, and collect payment for the newly created article of clothing.

Another embodiment of the present invention is to stock a variety of finished and casual shirts in the retail location that individuals may choose from as the shirt to be modified. In the embodiment described herein, once a shirt has been selected, the individual may choose from a range of options for material for a skirt portion to be added to the shirt, obtain the individual's measurements, modify the chosen shirt using the individual's measurements into a longer length article of clothing that is suitable to be worn as a dress, and collect payment.

In an embodiment, the process of creating a dress begins when a shopper enters the retail location, either at a physical location or a virtual location such as an internet storefront. The shopper is met by a designer or stylist. The shopper may begin to discuss the dress desired by presenting a shirt that the shopper brought with them, or can send to the designer or stylist. In an alternative embodiment, the shopper may begin to browse racks of shirts, with or without the designer's assistance, to locate a shirt that meets the shopper's desires and requirements. Whether the shopper brings a shirt into the retail location, or sends a description, or finds and purchases a shirt from those stocked in the retail location, the shopper next consults with an in-store designer. The shopper may be included in the design of the dress, either designing the dress and selecting the skirt portion to be attached to the shirt personally, or taking recommendations from the designer to create a desired look or statement.

The designer first takes physical measurements of the shopper to determine the size of the skirt portion that will fit the shopper properly. In a non-limiting example, the measurement is performed using a standard tailor's measuring tape, captured from the shopper, or captured through other measurement methods as described below. Any additional information from the shopper as to desired fit is communicated from the shopper to permit the designer to select the appropriate skirt portion size. If the retail location is a virtual storefront, the shopper may transmit their measurements to the designer. Other methods for obtaining the shoppers measurements may be used instead of a standard tailor's measuring tape, such as size charts, computer scanning, visual scanning, or any other method now known or developed in the future.

After the shoppers measurements have been captured, the designer may work with the shirt brought in or purchased by the shopper to select the material, color, and/or design of the fabric to be used as the skirt portion to be joined to the shirt. Any material suitable for use in the manufacture of clothing may be used to create the skirt portion.

Upon the selection of the suitable skirt portion, and while the shopper waits, the designer then takes the shopper's shirt or other shirt type and the selected skirt portion to the assembly section of the retail location. There the designer joins the shirt and the selected skirt portion together to form a dress. In meeting the design expectation of the shopper, the designer may recommend, or the shopper may select, accessory items that are incorporated into the dress. Realizing the shopper's design may include attaching items such as lace, buttons, embedded crystals or other gems, bows, ribbons, grommets, stitching detailing, embroidering, pockets, belt loops, beading (both single or hanging strands), fringe, specialty buttons, detail created from fabric, zippers, and any kind of clothing design ornamentation known now or in the future. Upon the attachment and incorporation of all design features expressed by the shopper, the dress is completed. The designer then presents the dress to the shopper. The shopper then submits payment for the dress, along with any other items offered for sale which the shopper chooses, and leaves the retail location.

In an embodiment, the shopper or other individual may present a request for bulk orders to create multiple copies of a particular design, or to create multiple dresses having different designs. A bulk order may be created for any person, group, team, organization, or event.

Although the method and process set forth is one embodiment, it is to be understood that various details of the present invention may be changed without departing from the scope of the present invention.

Turning now to FIG. 1, in an exemplary embodiment a method for the creation of a dress in a retail location is presented. The retail location may be opened in any space such as a mall or a standalone location that permits the installation of the equipment and supplies required to perform the method to be described herein 100. In this embodiment the retail location may contain one or more shelving units 104 or hanging racks 108 within which shirts of various colors and designs are displayed for purchase by a shopper. As a shopper enters the retail location 100, the shopper may be directed to one of the shelving units 104 or hanging racks 108 to select a shirt that will be used in the creation of a dress. If a shopper brings a shirt with them into the retail location, intending this shirt to be the basis for the creation of a preferred dress, the shopper may or may not peruse the shelving unit 104 or the hanging rack 108.

Additionally, the retail location may have cooperative partnerships with suppliers that provide shirts or skirt portions. Such collaborative arrangements can be implemented in conjunction and collaboration with tee shirt designers, tee shirt or sports shirt printers, and tee shirt design companies. Additional collaborative arrangements may be made between the retail location and fabric stores, clothing manufacturers, apparel brands, outside designers or clothing design companies, celebrities or other well-known entities, embroidery or logo/design businesses, advertising agencies, apparel representatives, and/or apparel sales companies. The retail location may also license outside vendors to represent and/or sell dress designs and dresses.

The shopper will be met upon entry to the retail location by a designer who will assist the shopper with the process of the creation of a dress joining a shirt upper portion to a skirt or skirt fabric lower portion. The designer will work with the shopper to either select a shirt from one of the shelving units 104 or hanging racks 108. If the shopper has a shirt upon entry to the retail location 100, the designer will work with the shopper to define and locate a skirt portion or skirt fabric to be joined to the shirt. A selection of skirt portions and skirt fabrics are stocked in the retail location in one or more retail skirt shelving unit(s) 112. Based upon the design and color of the shirt that will form the upper half of the dress, the designer will assist the shopper to select a skirt portion or skirt fabric from the skirt shelving unit(s) 112 that will complement the shirt and meet the shopper's expectations.

After a skirt portion or skirt fabric has been selected from the skirt shelving unit(s) 112, the designer will take the shirt and the skirt portion to the assembly station 116. The assembly station 116 is not accessible to the shopper and may only be entered by the designer and other employees of the retail location 100. The assembly station 116 contains all of the equipment necessary to join the shirt to the skirt portion and to perform any finish work such as thread cutting, or any other step required to create the dress. The designer, or other designated employee, will join the shopper's shirt and the selected skirt portion together using either a stitch, such as a serge stitch, that is capable of holding well yet providing some expansion or give to permit the garment to be worn comfortably, or any other method of joining the shirt to the skirt portion as previously described. As a point of social consideration, scraps of fabrics or other accessories resulting from the creation of the dress may be made into other products instead of simply discarded. Such products may include, but are not limited to, tee scarves or tee shirts for dogs or pets.

The designer will exit the assembly station 116 and return to the main section of the retail location 100 with the completed dress. The shopper then takes possession of the dress from the designer and proceeds to the point-of-sale (POS) station 120 within the retail location. If the shopper has provided payment prior to completion of the dress, the shopper may leave with the dress and/or other purchased items. If the shopper has not yet provided payment, the shopper may pay for the dress and any other purchased items prior to leaving the retail location. The shopper may provide payment for all items through any payment method accepted by the retail location, including, but not limited to, cash, credit, debit, bit coins, virtual payment through third party intermediaries, or any other payment method existing now or created in the future. The shopper next submits payment for the dress along with any other items offered for sale that the shopper chooses and exits the retail location 100.

Figure 2:
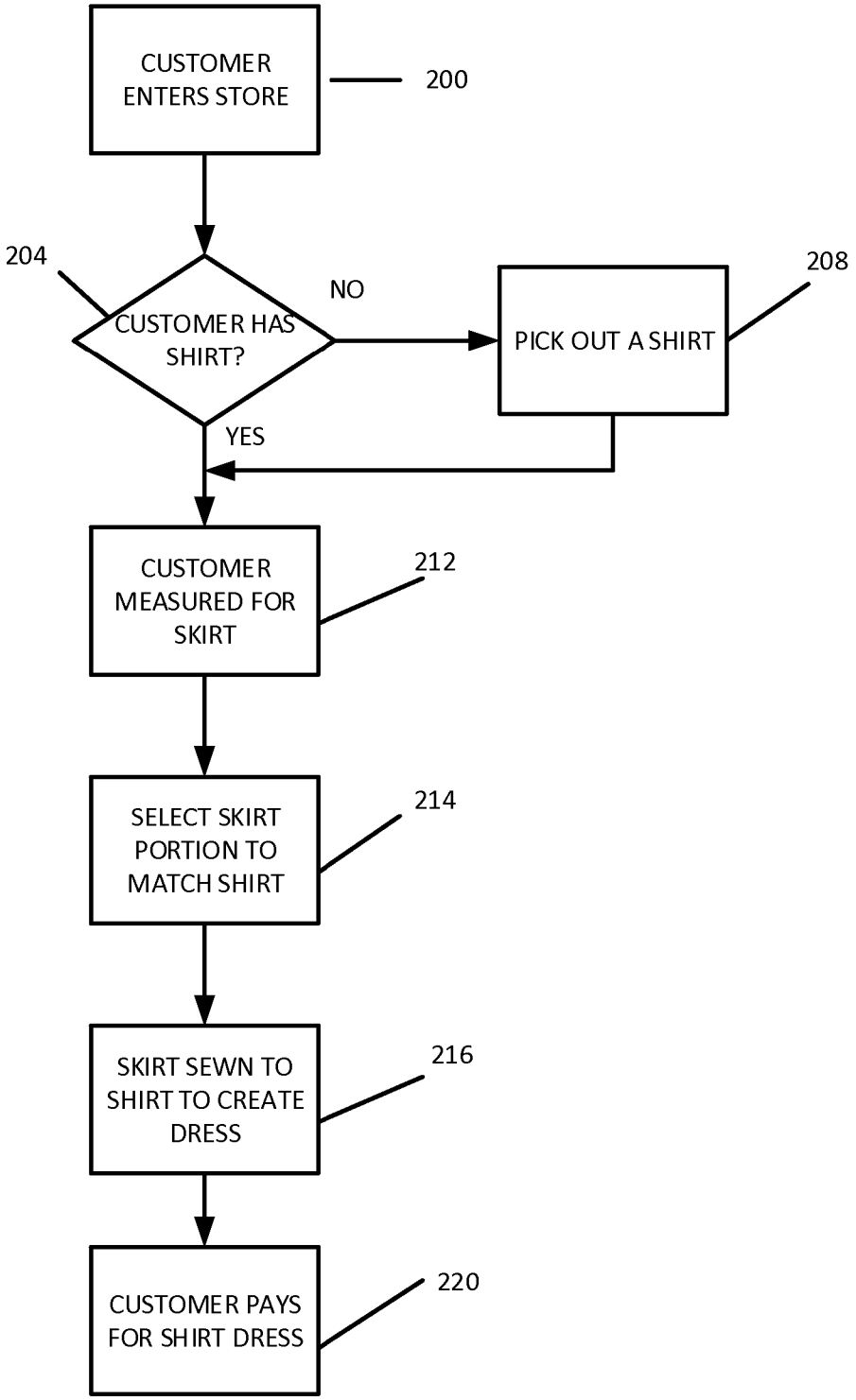
FIG. 2 presents a process flow for the creation of a dress constructed from an existing shirt and a skirt portion in a retail location consistent with certain embodiments of the present invention.

Turning to FIG. 2, this figure presents a description of the method for the creation of a dress having a shirt upper portion joined to a skirt or skirt fabric lower portion in a retail location consistent with certain embodiments. In this embodiment, the customer, a shopper interested in purchasing a dress, enters the physical or virtual retail location 200. Upon entering the retail location, a shopper is met by a designer or other employee of the retail location to determine if the shopper has entered the retail location with or without a shirt in hand 204, or if the shopper has a shirt that will be sent to the retail location if the location is virtual, such as an internet store front. In the event that the retail location is a virtual storefront, a diagram or image of the shirt may be presented by the shopper prior to sending the physical article to the virtual storefront.

If the shopper does not have a shirt in their possession upon entry to the retail location, the designer or other store employee will direct the shopper to the shelving, shelving racks or website page where shirts for purchase are on display within the retail location. The designer or other store employee will assist the shopper in the selection of a shirt, based upon shopper preferences, or will simply be available to answer any questions the shopper might have with regard to the shirts as the shopper browses the shelves, hanging racks, or website page(s).

After the presentation or selection of a shirt has been completed, a designer will assist the shopper further. The designer may physically measure the shopper to determine the size of the skirt portion that will fit the shopper properly at 212, or inquire as to the shoppers measurements if the retail location is a virtual store front. In a non-limiting example, the measurement is performed using a standard tailor's measuring tape, captured from the shopper, or captured through other measurement methods as described below. Any additional information from the shopper as to desired fit is communicated from the shopper to permit the designer to select the appropriate skirt portion size. If the retail location is a virtual storefront, the shopper may transmit their measurements to the designer. Other methods for obtaining the shoppers measurements may be used instead of a standard tailor's measuring tape, such as size charts, computer scanning, visual scanning, or any other method now known or developed in the future. The designer then will work with the shirt brought in or purchased by the shopper to select the material, color, and/or design of the fabric to be used as the skirt portion to be joined to the shirt at 214.

At 216, the designer takes the shirt from the shopper and the skirt portion to be joined to the shirt into the assembly section of the retail location. There the designer, in a non-limiting embodiment, may use a serge or other sewing stitch to join the shirt to the selected skirt portion. Other methods of joining the shirt to the selected skirt portion may be used instead of, or in addition to, joining the shirt to the selected skirt portion though one or more sewing stitches. Such joining may be accomplished by joining with Velcro, elastic, grommets, lacing, buttons, or any other method of joining known now or developed in the future. To accomplish the joining of the shirt to the selected skirt portion through the use of a sewing stitch, the designer may invert the shirt and the selected skirt portion and overlap the lower edge of the shirt and the upper edge of the selected skirt portion in a sufficient manner to permit a full sewing stitch to be applied to the entire circumference of the shirt and skirt portions so as to form a single garment. Other methods of joining may be used instead of a sewing stitch, however, each method securely attaches the shirt to the selected skirt portion. The shirt and skirt portion, now in the form of a dress, having an upper shirt portion and a lower, joined, skirt portion, are inverted again to turn them right side out. Other methods of joining the shirt and skirt portion may not require the inversion of each portion prior to joining. The designer then presents or otherwise conveys the completed dress to the shopper.

At 220, the shopper receives possession of the completed dress and submits payment for the dress and any other items that the shopper has chosen to purchase.

Figure 3:
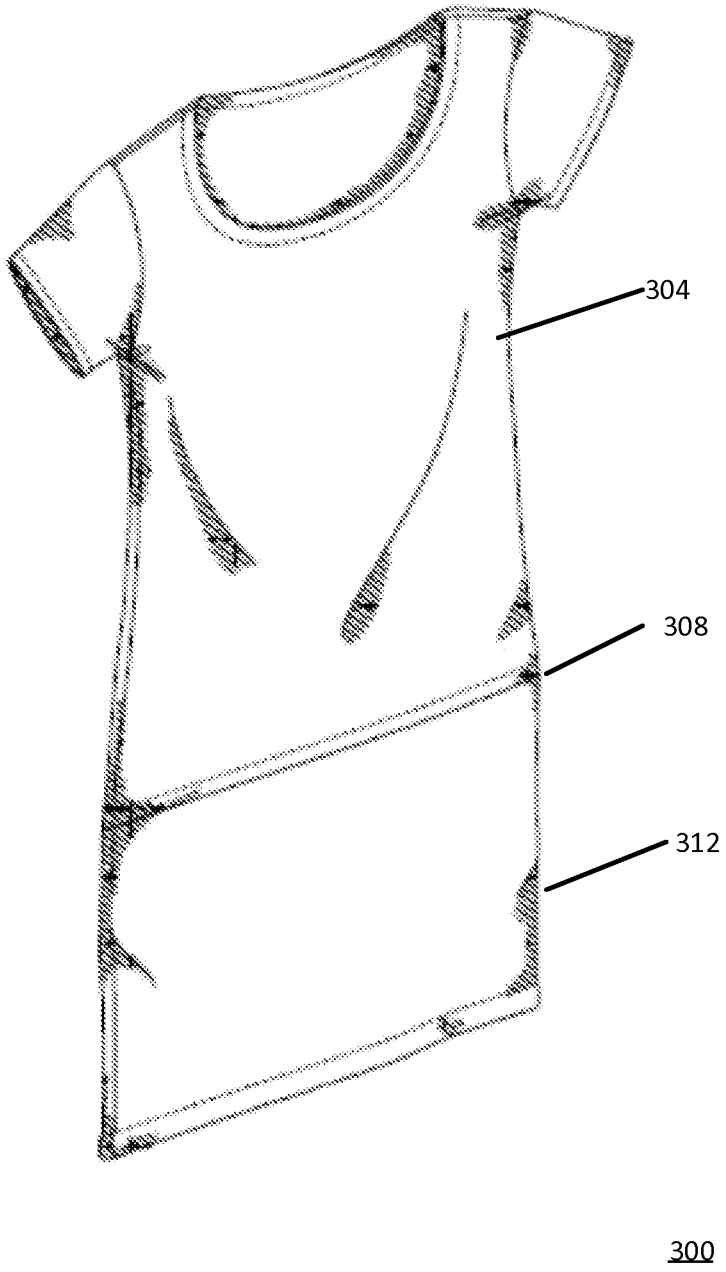
FIG. 3 presents a front view of the completed dress consistent with certain embodiments of the present invention.

Turning now to FIG. 3, this figure presents a front view of the completed dress consistent with certain embodiments of the present invention. The top portion of the dress 300 is comprised of the shirt 304 that was either purchased in the retail location or brought to the retail location in the possession of the shopper. The shirt is joined 308 to the skirt portion 312 that forms the lower portion of the dress 300. The steps performed in the retail location assembly station permit the creation of the dress 300 from the as described joining of the shirt 304 to the skirt portion 312.

The completed dress 300 is created within the retail location, as described above, and the shopper receives as a final result a dress in conformance with the item presented in FIG. 3.

Figure 4:
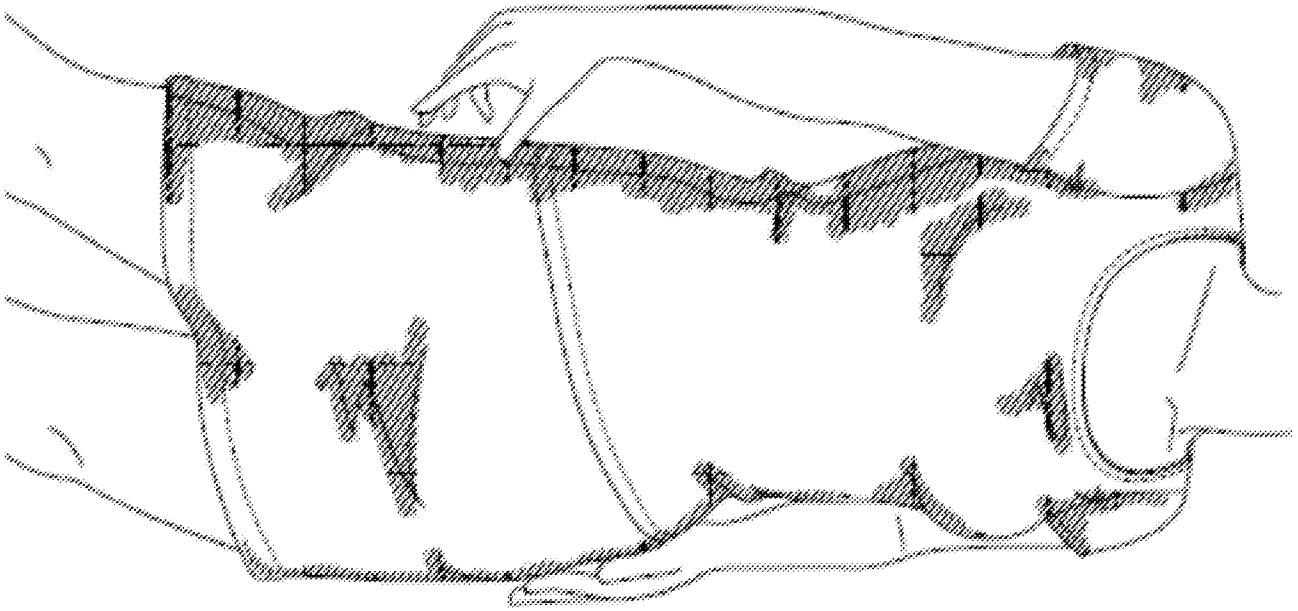
FIG. 4 presents a view of the completed dress worn by a shopper consistent with certain embodiments of the present invention.

Turning now to FIG. 4, this figure presents a view of the completed dress worn by a shopper consistent with certain embodiments of the present invention. This view is not to be considered limiting as additional elements may be introduced during the assembly process steps to address shopper desires. Such elements may include lace or other fabric along edges, seams, and hemlines. Additionally, finish work such as fringe or bead work, buttons, grommets, applique, zippers, or any other accessory items may be added to the dress to further personalize the dress or be used as a method for joining the shirt to the skirt portion.

These additional steps to the creation of the dress may be performed at the request of the shopper during the dress creation. The materials and fabrics may also be stocked in the retail location such that a shopper may select and purchase these additional elements to be attached to a personalized dress during the assembly step of the process, or brought home (such as beading kits).

In an embodiment, the retail location may also provide ready-made dresses that are pre-manufactured and on display for immediate sale to shoppers. These dresses, as well as all other retail items, may be displayed on racks that can be rolled off the floor of the retail location into a special storage area for events, fashion shows, fund raisers, parties, and special sales events that may include events in the retail location, at outside locations, or in-home parties and events. Retail locations may have fashion shows which feature "best dress" of the week, month, or year, as well as displaying examples of customer favorites. Retail locations may have special features such as hair salons and spas adjacent to the clothing section, and tea and beverage bars, so that while a dress is being manufactured the shopper may enjoy special treatment.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. The definitions are intended as a part of the description of the invention. The foregoing description is for the purpose of illustration only, and not for the purpose of limitation.

What is claimed is:

1. A method for the creation of a dress in a retail location, comprising:

receiving a previously existing shirt from a shopper within a retail location;

selecting a skirt portion from supplies of such skirt portions in the retail location;

said retail location providing said shopper with existing accessory items and accepting instructions from said shopper for modification of said previously existing shirt;

modifying said previously existing shirt to attach said selected skirt portion and selected additional previously existing accessory items to said previously existing shirt in accordance with instructions from said shopper so as to form a dress;

presenting the shopper in the retail location with said completed dress comprising said previously existing shirt, selected skirt portion and additional previously existing accessory items;

accepting payment through a payment method accepted by the retail location for the dress.

2. A method as in claim 1, wherein said previously existing shirt received from a shopper may either be a shirt the shopper brings to the retail location from outside the retail location, or a shirt the shopper purchases from the retail location.

3. A method as in claim 1, wherein the shopper is measured physically through the use of a measuring tape, size charts, computer scanning, or visual scanning for a skirt portion to be joined to the shirt.

4. A method as in claim 3, wherein the skirt portion is selected from the stock of skirt portions or fabric available for sale, from which a skirt is constructed within the retail location.

5. A method as in claim 1, wherein the joining of the shirt to the selected skirt portion is performed in an assembly section of the retail location.

6. A method as in claim 5, wherein the joining further comprises placing the lower edge of the shirt and the upper edge of the selected skirt portion adjacent to one another to permit a sewing stitch to be applied to the circumference of the shirt and skirt portions so as to form a single garment that is the dress.

7. A method as in claim 6, wherein the dress may be either joined or modified with additional fabric, or elements such as lace, fringe, beading, or other accessories as requested by a shopper.

8. A method as in claim 1, wherein the shopper does not receive possession of the dress until the payment offered is accepted by the retail location.

9. A system for the creation of a dress in a retail location, comprising:

receiving a previously existing shirt from a shopper within a retail location;

recording measurements associated with said shopper and creating a skirt portion size from said recorded measurements;

selecting a skirt portion from supplies of such skirt portions in the retail location;

said retail location providing said shopper with existing accessory items and accepting instructions from said shopper for modification of said previously existing shirt;

modifying said previously existing shirt to attach said selected skirt portion and selected additional previously existing accessory items to said previously existing shirt in accordance with instructions from said shopper so as to form a dress;

presenting the shopper in the retail location with said completed dress comprising said previously existing shirt, selected skirt portion and additional previously existing accessory items;

accepting payment through a payment method accepted by the retail location for the dress.

10. A system as in claim 9, wherein the shirt received from a shopper may either be a shirt the shopper brings to the retail location from outside or a shirt the shopper purchases from the retail location.

11. A system as in claim 9, wherein the shopper is measured physically through the use of a measuring tape, size charts, computer scanning, or visual scanning to determine the size for the skirt portion to be joined to the shirt.

12. A system as in claim 11, wherein the skirt portion is selected from the stock of skirt portions or fabric available for sale, from which a skirt is constructed within the retail location.

13. A system as in claim 9, wherein the joining of the shirt to the selected skirt portion is performed in an assembly section of the retail location.

14. A system as in claim 13, wherein the joining further comprises placing the lower edge of the shirt and the upper edge of the selected skirt portion adjacent to one another to permit a sewing stitch to be applied to the circumference of the shirt and skirt portions so as to form a single garment that is the dress.

15. A system as in claim 14, wherein the dress may be either joined or modified with additional fabric, or elements such as lace, fringe, beading, or other accessories as requested by a shopper.

16. A system as in claim 9, wherein the shopper does not receive possession of the dress until the payment offered is accepted by the retail location.

* * * * *